US009056352B2

(12) United States Patent
McBain

(10) Patent No.: US 9,056,352 B2
(45) Date of Patent: Jun. 16, 2015

(54) CLIPPING DIE FOR CLIPPING A COMPONENT

(75) Inventor: John McBain, Glasgow (GB)

(73) Assignee: ROLLS-ROYCE plc, London (GB)

( * ) Notice: Subject to any disclaimer, the term of this patent is extended or adjusted under 35 U.S.C. 154(b) by 332 days.

(21) Appl. No.: 13/297,580

(22) Filed: Nov. 16, 2011

(65) Prior Publication Data

US 2012/0151755 A1 Jun. 21, 2012

(30) Foreign Application Priority Data

Dec. 16, 2010 (GB) ..... 1021373.4

(51) Int. Cl.

| | |
|---|---|
| ***B26D 5/08*** | (2006.01) |
| ***B26D 7/06*** | (2006.01) |
| ***B21J 5/02*** | (2006.01) |
| ***B21K 3/04*** | (2006.01) |

(52) U.S. Cl.
CPC *B21J 5/027* (2013.01); *Y10T 29/52* (2015.01); *B21K 3/04* (2013.01)

(58) Field of Classification Search
CPC ..... B21J 1/00; B21J 5/027; B21K 3/04; H01L 21/00; H01L 21/50; H01L 21/56; F03B 17/06; F03B 3/12; Y10T 29/52
USPC ..... 83/140, 142, 143, 150, 613
See application file for complete search history.

(56) References Cited

U.S. PATENT DOCUMENTS

| | | | | |
|---|---|---|---|---|
| 2,714,556 | A * | 8/1955 | Goetzel | 419/5 |
| 2,716,270 | A * | 8/1955 | Gibian | 29/889.7 |
| 3,172,327 | A * | 3/1965 | Hazzard | 83/690 |
| 3,845,651 | A * | 11/1974 | Vau | 72/332 |
| 4,877,174 | A * | 10/1989 | Bruhn | 228/5.1 |
| 6,128,987 | A * | 10/2000 | Nakagawa et al. | 83/76.9 |
| 6,656,417 | B2 * | 12/2003 | Kohara et al. | 419/66 |
| 6,804,983 | B2 * | 10/2004 | Mori et al. | 72/350 |
| 6,871,524 | B2 * | 3/2005 | Olsson | 72/355.6 |
| 7,067,357 | B2 * | 6/2006 | Terui et al. | 438/123 |
| 7,100,417 | B2 * | 9/2006 | Yamanaka et al. | 72/448 |
| 2009/0260410 | A1 * | 10/2009 | Cho et al. | 72/356 |
| 2009/0293573 | A1 * | 12/2009 | Matsui | 72/358 |

FOREIGN PATENT DOCUMENTS

| | | |
|---|---|---|
| GB | 720470 | 12/1954 |
| GB | 771639 | 4/1957 |

(Continued)

OTHER PUBLICATIONS

Apr. 23, 2012 European Search Report issued in European Application No. 11 18 9312.

(Continued)

*Primary Examiner* — Ghassem Alie
*Assistant Examiner* — Bharat C Patel
(74) *Attorney, Agent, or Firm* — Oliff PLC

(57) ABSTRACT

A clipping die for clipping a component, the clipping die including a riser having a support surface with a cutting edge for clipping the component under the action of a punch. A referencing member is provided for engagement with a reference portion of the component. The referencing member is mounted on a resilient element. The resilient element is depressed under the action of a punch to move the referencing member into a position such that the component is fully supported by the support surface during the clipping process.

6 Claims, 2 Drawing Sheets

(56) References Cited

FOREIGN PATENT DOCUMENTS

| | | |
|---|---|---|
| GB | 804468 | 11/1958 |
| GB | 897133 | 5/1962 |
| JP | A-63-286234 | 11/1988 |
| JP | A-1-274922 | 11/1989 |

OTHER PUBLICATIONS

Jan. 25, 2011 British Search Report issued in British Patent Application No. GB 1021373.4.

* cited by examiner

CLIPPING DIE FOR CLIPPING A COMPONENT

The present invention relates to a clipping die for clipping a component and particularly but not exclusively to a clipping die for clipping a forged component such as an aerofoil of a compressor stator vane or blade.

Metal components are forged by applying compressive loads to form the metal into the desired shape. This is conventionally achieved by placing the metal between two dies which are forced together such that the metal forms into the interior profile of the dies. In doing so, metal is often forced through the interface of the two dies, the parting line, creating a burr around the component, known as flash. The flash can be removed by a subsequent clipping or trimming process.

Conventionally, clipping processes use a clipping die to hold a component as it is forced through clipping steels having an aperture sized to the desired final shape of the component. The component is placed on top of the die so that the flash extends outside. The component is then forced through the opening in the clipping steels by a punch causing the flash extending outside the dies to be sheared from the component.

A clipping process is shown in FIGS. 1 and 2 for clipping components having an aerofoil surface, such as a compressor stator vanes or blades. The process uses a clipping die 2, as shown in FIG. 1, having a riser portion 4 and a base portion 6. The riser portion 4 comprises a support surface 8 for supporting the component above the base portion 6. The support surface 8 comprises cutting edges 10 disposed on opposing sides of the support surface 8. In practise, the cutting edges 10 in fact may be a single cutting edge which extends around the whole of the riser portion 4.

The riser portion 4 further comprises referencing members 12 disposed at opposing ends of the riser portion 4 adjacent to the support surface 8. A recess 14 is provided for receiving a root portion of the component.

As shown in FIG. 2, the riser portion 4 is located accurately within a pair of clipping steels 16 (shown cutaway for diagrammatical purposes). The riser 4 and base 6 are mounted on a hydraulic cylinder which provides a reaction force to counter act the force of a punch (not shown). The punch is driven down under hydraulic power to clamp the component on the riser 4 and drive the punch, component and riser 4 down through the clipping steels 16. As the punch, component and riser 4 pass through the clipping steels 16, flash is sheared off between the edges of the punch and the clipping steels 16.

In use, the component is placed on the riser 4, such that the root portion is received within the recess 14. The component is provided with two pips which act as reference portions that engage with the referencing members 12. The reference portions may be forged into the component for this purpose, or they may be an artefact of the forging process resulting from a gutter provided in the dies to allow overflow of excess metal.

A problem with this known arrangement is that, as a result of forging variations, the component is not always fully supported in the die during the clipping process. Whilst the referencing members 12 support the pips on the component the aerofoil surface is spaced away from the support surface 8 and the cutting edges 10. As a result, the action of the punch causes the flash to be torn from the component which is deformed away from its original shape during the clipping process. The incorrect seating of the component on the clipping die creates residual stresses in the clipped component as it is elastically bent into the cutting position. This can ultimately lead to the failure of the component when in service.

The present invention seeks to address the problems associated with the above described clipping die 2.

In accordance with a first aspect of the invention there is provided a clipping die for clipping a component, the clipping die comprising: a riser having a support surface with a cutting edge for clipping the component under the action of a punch; at least one referencing member for engagement with a reference portion of the component; the reference member being mounted on a resilient element.

The resilient element allows the referencing member to move in the direction of action of the punch. The action of the punch causes the resilient element to be depressed to move the referencing member in to a position such that the component is fully supported by the support surface and brings the component into contact with the cutting edge of the support surface.

The resilient element may be a compression spring located under the referencing member.

Two referencing members may be provided for engagement with reference portions located at opposing ends of the component.

The clipping die may be located on a hydraulic cushion.

The component may be a component of a turbomachine.

The component may be a rotor blade or stator vane.

The present invention will now be described with reference to the accompanying drawings, in which.

Figure 1:
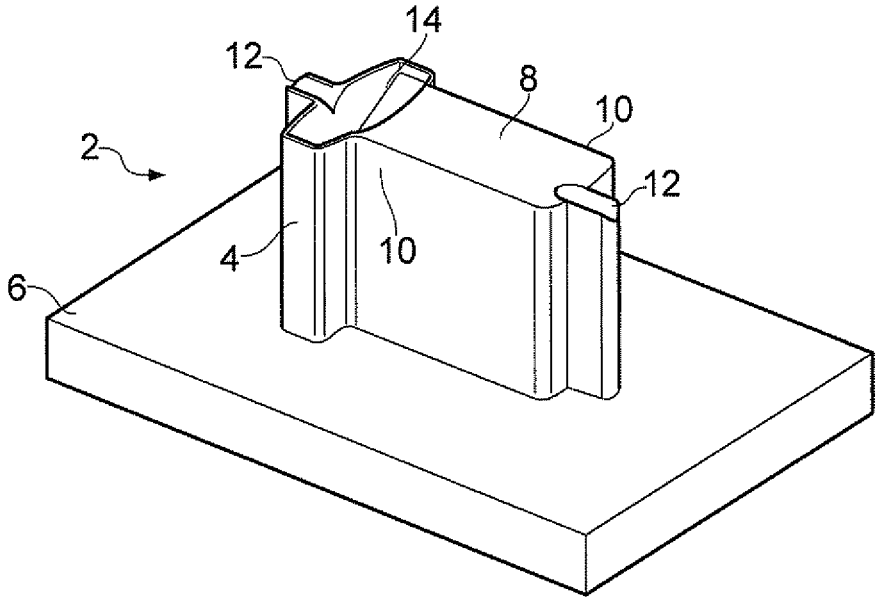
FIG. 1 (Prior Art)
FIG. 1 is a perspective view of a prior art clipping die.
Figure 2:
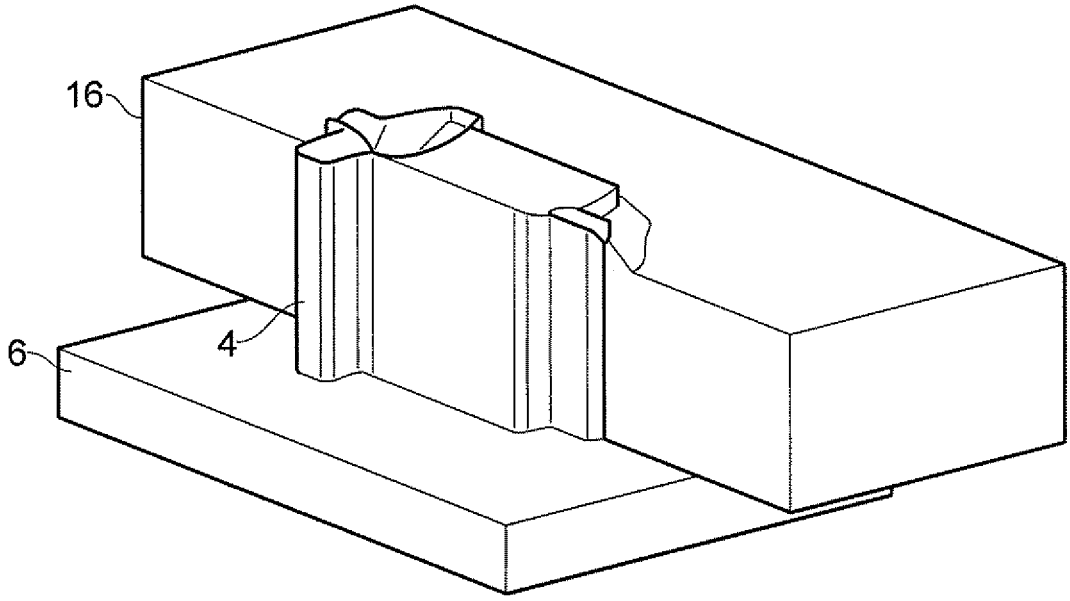
FIG. 2 (Prior Art)
FIG. 2 is a perspective view of the prior art clipping die shown in FIG. 1, the cutting steels are shown cutaway for diagrammatical purposes.
Figure 3:
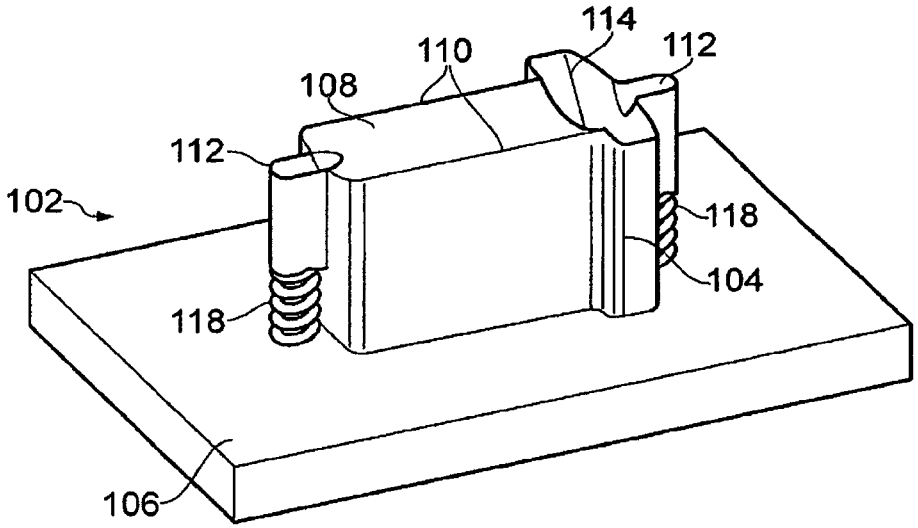
FIG. 3 is a perspective view of a clipping die in accordance with a first aspect of the invention.

Referring to FIG. 3 a clipping die 102 has a riser portion 104 and a base portion 106. The riser portion 104 comprises a support surface 108 for supporting a component, such as an aerofoil above the base portion 106. The support surface 108 has cutting edges 110 disposed on opposing sides of the support surface 108 and a recess 114 is provided for receiving a root portion of the component.

The support surface 108 is recessed in the centre to allow full contact with the curved aerofoil surface so that the component is supported during the clipping process. The riser portion 104 further comprises referencing members 112 disposed at opposing ends of the riser portion 104 adjacent to the support surface 108. The referencing members 112 are separate from the support surface 108 and are mounted on resilient elements 118 shown as springs. The referencing members 112 are movable relative to the support surface 108 through the depression of the springs 118.

Figure 4:
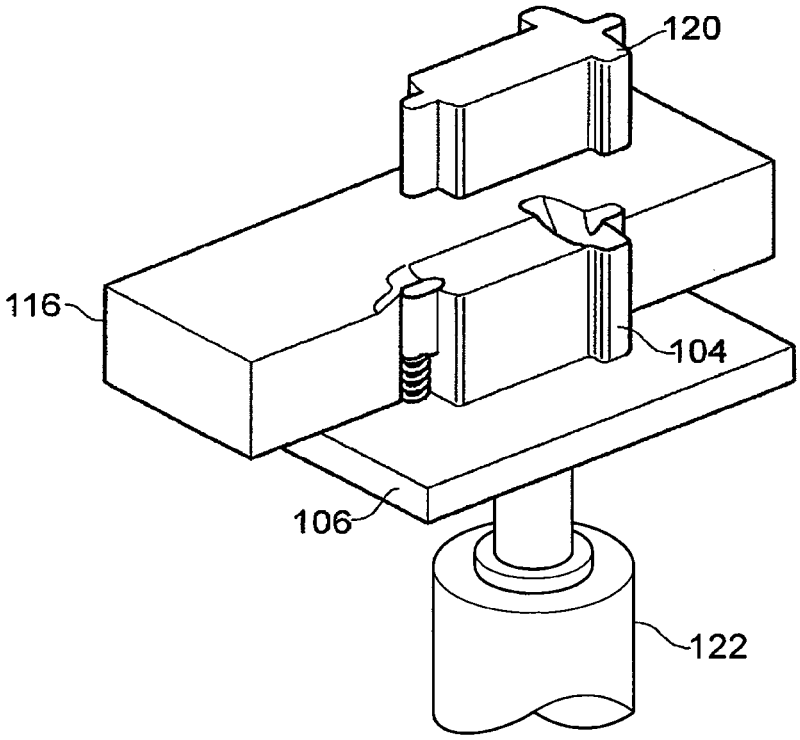
FIG. 4 is a perspective view of the clipping die of FIG. 3 showing the cutting steels and a punch.

As shown in FIG. 4, the riser portion 104 is located within cutting steels 116 (shown cutaway for diagrammatical purposes). In use, the component is placed on the riser 104, such that the root portion is received within the recess 114. The component has two pips which act as reference portions that engage with the referencing members 112. As described above, the reference portions may be forged into the component for this purpose or they may be an artefact of the forging process resulting from a gutter provided in the dies to allow overflow of excess metal.

The clipping die 102 is configured so that the component should engage with the referencing members 112 via its reference portions and the component is supported by the support surface 108 when clipping occurs at the cutting edges 110. However if variations in the forged component occur the component may not be supported when the reference portions of the component are engaged with the referencing members 112 or alternatively the reference portions of the component may be spaced away from the referencing members 112 when the component is located against the cutting edges 110.

To ensure the positional accuracy of the component in the clipping die 102 the referencing members 112 of the present invention are mounted on the springs 118. By mounting the referencing members 112 on springs 118 they can be displaced relative to the support surface 108 such that the component contacts both the referencing members 112 and the support surface 108 regardless of any minor variations in the dimensions of the component.

The referencing members 112 translate relative to the support surface 108 and cutting edges 110 under the action of the punch 120. During the clipping process, the punch 120 is driven down under hydraulic pressure onto the component causing the referencing members 112 to translate through the depression of the springs 118 until the component is fully supported on the surface 108. The hydraulic pressure continues to drive the punch 120, the component and the riser 104 through the clipping steels 116 at which point the flash is sheared at the cutting edges 110 between the punch 120 and the clipping steels 116. A hydraulic cylinder 122 below the base 106 of the riser 104 provides a reaction force which counter acts the force of the punch 120 so as to support the sides of the component thus reducing tearing of the component.

The reference members 112 can be moved independently by depression of the associated spring elements 118. This improves the positional accuracy of the component within the die 102 so that there is minimal stress placed on the component during clipping. Elastic deformation of the component into contact with the cutting edges as experienced with the prior art clipping die 2 is avoided and the residual stresses in the clipped component are therefore greatly reduced.

The present invention may be applied where it is desired to improve the seating of a component over a cutting edge during a clipping process and thus to reduce the residual stresses in the clipped component.

The present invention may find particular application in the aerospace industry for clipping components with an aerofoil surface, such as compressor blades or vanes, however it may be applied to other components found within a turbomachine and also in other industries where the benefits of the invention are desired.

The invention claimed is:

1. A clipping die for clipping a component, the clipping die comprising:

a riser having a support surface with a cutting edge for clipping the component under the action of a punch;

two independently movable referencing members provided for engagement with reference portions located at opposing ends of the component; and two resilient elements built to be independent of each other, wherein the two referencing members are each mounted on a respective one of the resilient elements, and under the action of the punch: (i) the riser moves through clipping steels to clip the component, and (ii) each of the resilient elements can independently displace the respective one of the two referencing members into a position such that the component is fully supported by the support surface.

2. The clipping die as claimed in claim 1 wherein the action of the punch causes the resilient elements to be depressed to displace the referencing members into a position such that the component is fully supported by the support surface and brings the component into contact with the cutting edge of the support surface as the component moves down through the clipping steels.

3. The clipping die as claimed in claim 1 wherein each of the resilient elements are compression springs located under a respective one of the referencing members.

4. The clipping die as claimed in claim 1 wherein the clipping die is mounted on a hydraulic cylinder.

5. The clipping die as claimed in claim 1 wherein the component is a component of a turbomachine.

6. The clipping die as claimed in claim 1 wherein the component is a rotor or stator blade.

* * * * *